US005560520A

United States Patent [19]

Grogen

[11] Patent Number: 5,560,520

[45] Date of Patent: Oct. 1, 1996

[54] PRECOMPRESSION PUMP SPRAYER

[75] Inventor: R. Pat Grogen, Downey, Calif.

[73] Assignee: Calmar Inc., City of Industry, Calif.

[21] Appl. No.: 512,226

[22] Filed: Aug. 7, 1995

[51] Int. Cl.[6] ..... B65D 88/54

[52] U.S. Cl. ..... 222/321.2; 222/321.9

[58] Field of Search ..... 222/318, 321.2, 222/321.7, 321.9, 340, 383.1, 385, 382; 239/333

[56] References Cited

U.S. PATENT DOCUMENTS

| | | | |
|---|---|---|---|
| 4,025,046 | 5/1977 | Boris | 239/333 |
| 4,050,613 | 9/1977 | Corsette | 222/321.2 |
| 4,051,983 | 10/1977 | Anderson | 417/435 |
| 4,109,832 | 8/1978 | Kutik et al. | 222/340 |
| 4,140,249 | 2/1979 | Majima | 239/333 |
| 4,144,987 | 3/1979 | Kishi | 222/385 |
| 4,189,064 | 2/1980 | O'Neill | 222/385 |
| 4,262,823 | 4/1981 | Monden | 222/383 |
| 4,278,189 | 7/1981 | Kirk, Jr. | 222/382 |
| 4,402,432 | 9/1983 | Corsette | 222/321.2 |
| 4,437,588 | 2/1984 | Shay | 222/382 |
| 4,530,449 | 7/1985 | Nozawa et al. | 222/321.2 |
| 4,591,077 | 5/1986 | Corsette | 222/340 |
| 4,692,103 | 9/1987 | Anderson | 222/385 |
| 5,100,029 | 3/1992 | Meshberg | 222/321.9 |

FOREIGN PATENT DOCUMENTS

| | | |
|---|---|---|
| 2051969 | 1/1981 | United Kingdom . |
| 2110771 | 6/1983 | United Kingdom . |

*Primary Examiner*—Andres Kashnikow
*Assistant Examiner*—Philippe Derakshani
*Attorney, Agent, or Firm*—Watson Cole Stevens Davis, P.L.L.C.

[57] ABSTRACT

A precompression pump sprayer has a sliding discharge valve/secondary piston member in sliding telescoping engagement with an inlet conduit extending into a secondary portion of the pump cylinder forming therewith an annular chamber housing the piston return spring, the annular chamber having a vent/drain port opening directly into the container, and the member being cup-shaped and having openings sized to facilitate discharge valve opening and closing.

21 Claims, 2 Drawing Sheets

PRECOMPRESSION PUMP SPRAYER

BACKGROUND OF THE INVENTION

This invention relates generally to a precompression pump sprayer of the type in which a discharge valve seat, carried by the main piston, is opened upon a build-up of pressure in the pump chamber and is closed when that pressure is overcome by the force of a spring moving a valve member into its closing position. When the discharge passage is open, the fluid inlet to the pump chamber is closed, and while the discharge passage is being closed, the fluid to the chamber is reestablished.

U.S. Pat. No. 4,051,983 discloses a precompression pump sprayer of the class described in which the discharge valve forms a sub-assembly of three parts including a valve rod, a secondary piston operating in a secondary portion of the pump cylinder, and an inlet ball check valve, the sub-assembly moving together as a unit during the pressure and suction strokes of the main piston for controlling discharge and inlet passages from and into the main pump chamber as in the known pressure build-up sprayers of this type. The pump chamber is primed by expelling unwanted air therefrom directly into the container through the dip tube near the end of the downstroke of the sub-assembly, such that the expelled air is replaced by liquid from the container on each ensuing upstroke.

This three-part sub-assembly requires an additional part for the overall pump assembly which adds to the cost, and a sub-assembly operation and equipment are required which further increase time and expense.

The piston return spring is housed in a separate chamber beneath the subassembly which, during the process of priming the pump, collects liquid and expelled air from the pump chamber and tends to retard the priming ability of the pump.

This retarding effect is enhanced especially for viscous and difficult to prime liquids, thereby increasing the number of strokes-to-prime factor. Besides, the return spring housing of the U.S. Pat. No. 4,051,983 pump sprayer is in direct communication with the dip tube such that the return spring after priming is fully immersed in liquid product which may over time reduce the efficiency of the return spring or may cause contamination of the spring and/or liquid product itself.

British patent 2,051,969 discloses a precompression pump sprayer which includes a single piece member forming a discharge valve on one end and a secondary piston at its opposite end operating in a counterbore formed by an insert defining a secondary cylinder. This secondary cylinder forms a separate return spring housing in direct communication with the interior of the container via a separate air flow passage. The inlet check valve is located beneath the insert, and a separate product flow passage from the valve controlled inlet is established directly into the pump chamber through an outer groove formed in the side and bottom walls of the insert.

It is the objective of this prior art pump according to the British patent to isolate the return spring housing from the liquid flow path into the pump chamber, and to reduce any resistance or head loss which would retard pumping movement due to air within the spring chamber.

The pump structure according to this prior art sprayer gives rise to several disadvantages. Either a separate insert defining the spring housing must be provided, requiring a separate part which adds to the cost and is difficult to assemble, or should the insert to be formed integrally with the pump housing, an elongated bore must be molded in the housing wall to establish direct communication with the pump chamber, which is difficult and costly to mold.

Moreover, the spring chamber varies in volume during pump reciprocation, such that the column of air in the spring housing could retard movement of the discharge valve during the pump pressure stroke, and the expanding volume of the spring housing during the pump suction stroke could cause container collapse or hydraulic lock of the secondary piston during the suction stroke, unless product suctioned from the container is adequately replaced by atmospheric air through the container vent.

Besides, strokes-to-prime issues are not contemplated by this disclosure, as no pump priming means is even disclosed.

Moreover, neither of the aforedescribed pumps has the ability to regulate the rate at which the discharge is opened and closed by controlling the rate of reciprocation of the discharge valve/secondary piston during the pump operation.

SUMMARY OF THE INVENTION

An object of the present invention is to provide a precompression pump sprayer as an improvement over the prior art sprayers specifically avoiding the noted disadvantages aforedescribed and to provide additional advantages which will become more apparent hereinafter.

The pressure build-up sprayer according to the invention is structured to improve upon the strokes-to-prime ability of the pump by reducing the number of piston strokes needed to fully expel unwanted air from the pump chamber to be replaced by liquid from the container. The unwanted air from the pump chamber is expelled directly into the container through a separate path from that of the product inlet path. The piston return spring is housed in an annular chamber which includes the priming path such that the spring, although not immersed in the liquid product after priming, is nevertheless wetted with product during and after priming which is not disadvantageous. Moreover, the discharge valve/secondary piston according to the invention, of one-piece construction, is telescoped about an upstanding inlet conduit forming the annular chamber together with the pump cylinder and is designed to alter the pressure profile for the pump to effect quick acting or slow acting discharge control.

Other objects, advantages and novel features of the invention will become more apparent from the following detailed description of the invention when taken in conjunction with the accompanying drawings.

DETAILED DESCRIPTION OF THE INVENTION

Figure 1:
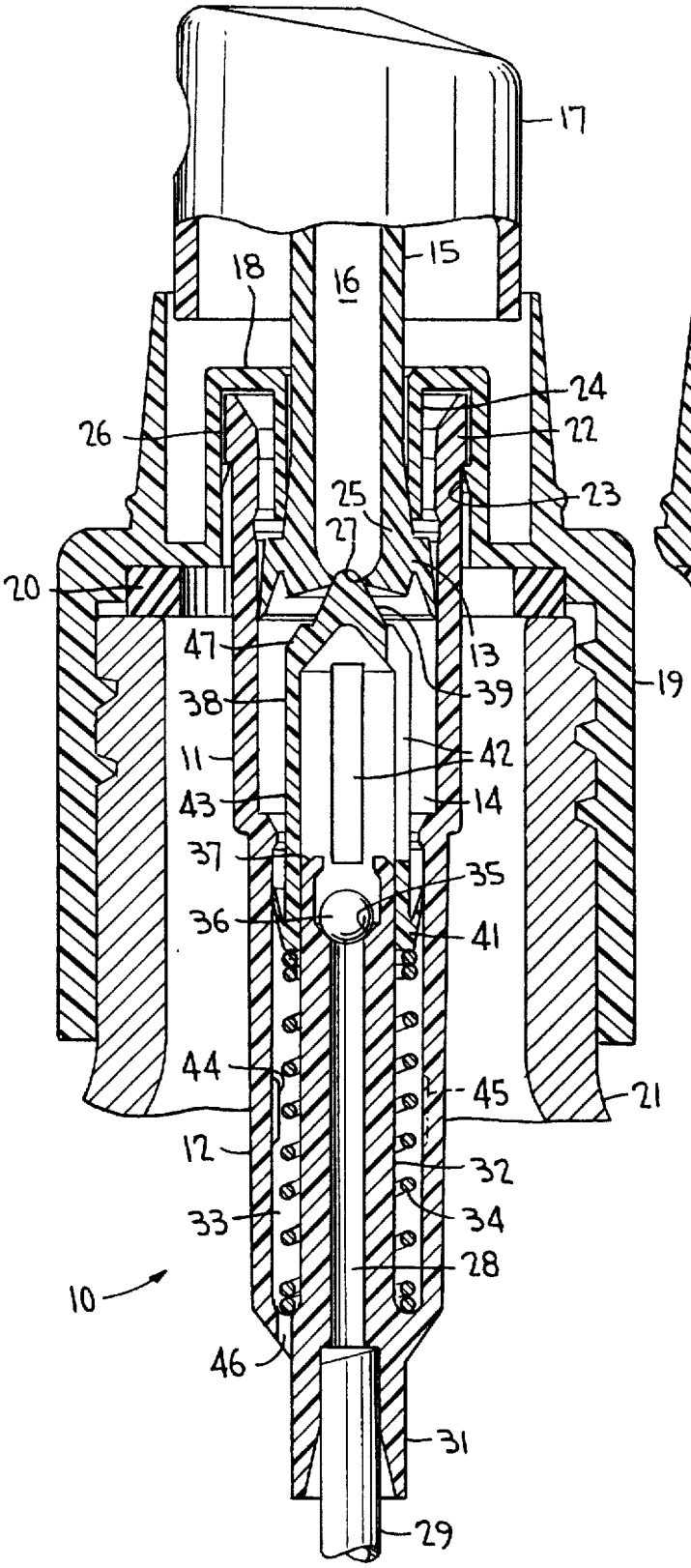
FIG. 1 is a vertical sectional view of the precompression pump sprayer according to the invention shown in the fully raised, inoperative position of the pump piston.

Turning now to the drawings wherein like reference characters refer to like and corresponding parts throughout the several views, the precompression pump sprayer according to the invention comprises a pump housing, generally designated 10, which includes a cylinder having an upper main cylinder portion 11 and a lower secondary cylinder portion 12 which may be of reduced diameter compared to portion 11.

A hollow, main pump piston 13 is reciprocable within cylinder portion 11 and therewith defines a variable volume pump chamber 14, the piston having a hollow stem 15 defining a discharge passage 16, a plunger head 17 being mounted on the stem to facilitate manual piston reciprocation in the known manner. The plunger head has an orifice cup including a discharge orifice and spin mechanics (not shown) to effect the discharge of product as a fine mist spray during pumping operation.

The upper end of the cylinder is mounted within a crown portion 18 of a container closure 19 provided for thread mounting the cylinder to container neck 21 of a container (not otherwise shown). Otherwise, the closure can be mounted to the container as by a snap fit. An annular elastomeric seal 20 is typically provided between the upper end of the container neck and the underside of the closure.

Engagement between the upper end of main cylinder portion 11 and crown portion 18 may be effected by the provision of an enlargement 22 at the upper end of cylinder portion 11 in snap fitting engagement with an internal snap bead 23 on crown portion 18. A depending sleeve 24 on crown portion 18 presents a central opening through which stem 15 extends. The lower portion of sleeve 24 sealingly engages enlargement 25 of the piston stem in the inactive, non-pumping position of FIG. 1, and the upper portion of sleeve 24 has a slightly greater inner diameter compared to the outer diameter of stem 15, defining a portion of a container vent passage during the FIG. 3 pumping operation. Such passage is further defined by aligned grooves 26 provided in enlargement 22 and in snap bead 23. Otherwise, a groove may be provided on the inner surface of crown portion 18, as shown in U.S. Pat. No. 4,051,983, to establish a container vent passage during pumping for the ingress of atmospheric air into the container to avoid container collapse and hydraulic lock of the piston during pumping, as in a manner well known in the art.

Pump chamber 14 communicates with discharge passage 16 via discharge port 27 controlled by a discharge valve to be described more fully hereinafter, and the pump chamber communicates further with an inlet passage 28 communicating with liquid in the container via a dip tube 29 mounted to lower end 31 of cylinder portion 12 and extending below the level of liquid in the container.

Inlet passage 28 is defined by an elongated stationary conduit 32 extending into secondary cylinder portion 12 and forming together therewith an annular housing 33 for the reception of a piston return spring 34. The upper inner end of conduit 32 forms a valve seat 35 supporting an inlet check valve which may be in the form of a ball valve 36 surrounded by upstanding spaced fingers 37 forming a ball cage.

An inverted, cup-shaped valve member 38 has a conically shaped discharge valve 39 at one end seated against discharge valve seat 27 for closing the discharge passage and has at its opposite end a secondary piston 41 generally aligned with the main piston. Valve member 38 telescopes over inlet conduit 32 in sliding sealing engagement therewith and its secondary piston operates in annular chamber 33 against the force of return spring 34 which, in the inoperative position of FIG. 1, spring biases valve 39 of member 38 against the main piston for closing the disclosure in a manner known in the precompression pump sprayer art.

Communication between pump chamber 14 and the valve-controlled inlet passage is established by the provision of one or more, such as three, elongated openings 42 provided in side wall 43 of member 38 which may extend between valve 39 and secondary piston 41. In such manner, the pump chamber likewise communicates with secondary piston 41.

Priming valve structure is provided for priming the pump, such structure comprising an axial rib 44 provided on the inner wall of cylinder portion 12, or an axial groove 45 (shown in phantom outline in FIG. 1) provided in such wall. The rib or groove is located at a position at or near the end of the downstroke of secondary piston 41 for releasing entrapped air from the pump chamber past the secondary piston and into the container via a vent/drain port 46 extending through the wall of cylinder portion 12 at a location below the location of the axial rib or groove.

Figure 2:
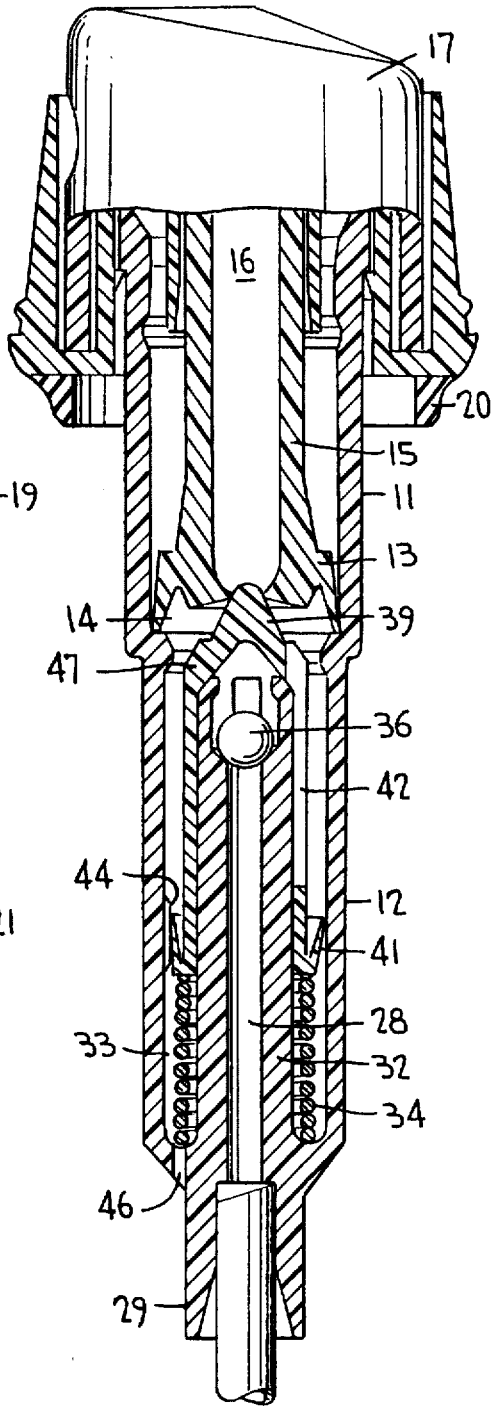
FIG. 2 is a view similar to FIG. 1 showing the pump piston at the end of its downstroke during priming.

In the unprimed condition of the pump, shown in FIG. 1, downward finger pressure applied against the plunger head lowers both pistons in unison to the position of FIG. 2 which is shown with the main piston fully stroked. The compressible air in the pump chamber is evacuated as a portion of the periphery of resiliently deformable secondary piston 41 is deflected inwardly upon contact with axial rib 44 whereupon the seal acting between the secondary piston and the inner wall surface of cylinder portion 12 is broken, thereby permitted downward flow of entrapped air from the pump chamber directly into the container through a separate path via port 46. To the extent that such air exerts pressure on the surface of the liquid product in the container, it assists in urging the product up the dip tube and through the inlet passage into the pump chamber on each ensuing upstroke of the pistons. The number of strokes required to effect priming, especially for viscous or difficult to prime liquids, is less as compared to known priming structures in that the retarding effect presented by air and liquid movement in opposite directions in the spring housing is diminished.

Similarly, the seal acting between secondary piston 41 and the inner wall surface of cylinder portion 12 is broken at or near the end of the downstroke of the secondary piston as it becomes juxtaposed to axial groove 45 permitting entrapped air from the pump chamber to be evacuated through annular chamber 33 and directly into the container via port 46.

Due to the telescoping arrangement between cup-shaped member 38 and conduit 32 according to the invention, head portion 47 functions as a reciprocating cylinder relative to the valved inlet conduit functioning as a stationary piston during each pressure stroke. Thus, openings 42 must be appropriately sized to avoid hydraulic lock of member 38 and to establish unobstructed flow between the interior of member 38 and the pump chamber and the secondary piston to avoid any retarding action during downward movement of member 38 which would otherwise occur by the compression of the air within the cup-shaped member 38 during priming or by the compression of liquid within member 38 during pumping.

Figure 3:
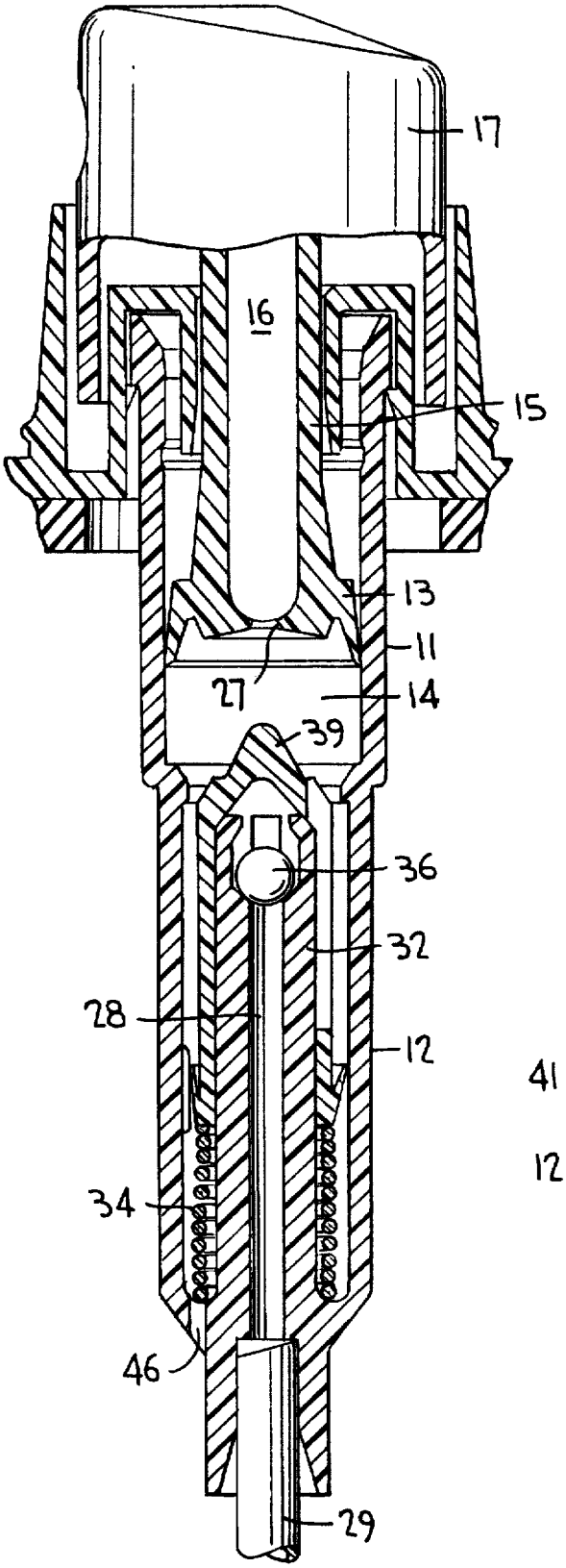
FIG. 3 is a view similar to FIG. 1 showing the pump piston during pumping operation.

Once the pump chamber is primed with liquid product, which should take in one or two plunger strokes, the pump is readied for pumping operation. Referring to FIG. 3, application of finger pressure on the plunger head in a downward direction lowers the main pump piston fully within the pump chamber, or to about a third of its full travel, due to the incompressibility of the liquid in the pump chamber. As the pressure in the pump chamber during each downstroke increases, to a threshold pressure which overcomes the opposing force of the return spring, member 38 separates from the main piston and slides with an annular chamber 33 substantially to its lowered position shown in FIG. 3, at which secondary piston 41 is juxtaposed to axial rib 44 or axial groove 45. In this position, the seal acting between the secondary piston and the inner wall surface of cylinder portion 12 is broken, whereupon some product drains from the pump chamber directly into the container via annular chamber 33 and port 46. Of course, when member 38 separates from the main piston, discharge passage 16 is opened, permitting product under pressure to be discharged through the discharge orifice as a fine mist spray. And, when the plunger is downwardly stroked, the interior of the container is opened to atmosphere via the container vent passage such that product which refills the pump chamber during each ensuing plunger upstroke created by the sub-atmospheric pressure in the pump chamber as it expands, is replaced by atmospheric air drawn into the container through the container vent passage to thereby avoid hydraulic lock and container collapse.

It should be pointed out that the escape of some liquid from the pump chamber into the container at the end of the pressure stroke through port 46 is minimal and can be tolerated as it has a minimal effect on the pumping capacity as product is discharged through the larger open discharge port/seat 27.

Thus, during priming, openings 42 must be sized to ensure that product inletting through the open inlet passage, which first inlets to the interior of member 38, fills the pump chamber without obstruction by sidewall 43 of the member. Relatively small openings 42 could impede the free flow of product into the pump chamber.

Likewise, openings 42 should be sized to ensure unobstructed flow between the interior of member 38 to the pump chamber under sufficient pressure bearing against the horizontal components of member 38 (such as the surface of head portion 47 and the upwardly extending seal of secondary piston 41) by which transmitted pump chamber pressure causes member 38 to separate from the main piston during pumping, causing member 38 to travel downwardly within annular chamber 33, as shown in FIG. 3. As in the U.S. Pat. No. 4,051,983 prior art pump sprayer, when the accumulated pressure in the pump chamber reaches a threshold pressure which exceeds the return force of the spring, member 38 is lowered in its annular chamber to open the discharge. When the pressure in the pump chamber falls below that threshold pressure, the return spring takes over and resiliently urges member 38 back into its closing position seated against valve seat 27 to thereby close the discharge and to cause the main piston and member 38 to return to their fully extended upstroke position of FIG. 1. A reduction in pump chamber pressure from its threshold pressure occurs, for example, upon release of finger pressure applied to the plunger head.

A quick acting or a gradual, slower acting discharge closing is made possible according to the invention. For example, by controlling the downward extent of travel of member 38, discharge valve 39 will more quickly or more slowly reseat against its valve seat when the return spring force exceeds the threshold pressure in the valve chamber, thereby producing a quick or a slower acting discharge cutoff. The larger the openings 42, the greater downward travel of member 38 away from the discharge valve seat, such that a longer time interval is required for member 38 to reclose the discharge, i.e., a slower acting discharge cutoff. The smaller the openings 42, the shorter the downward stroke of member 38 and consequently the shorter time interval effected to cut off the discharge, i.e., quick acting.

Figure 4:
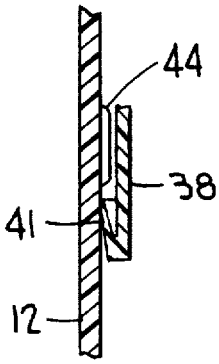
FIG. 4 is a vertical sectional view of part of the pump and discharge valve member relative to an alternately located priming valve.

According to another feature of the invention, shown in FIG. 4, the priming valve structure in the form of an axial rib 44 or an axial groove 45 is positioned on or at the inner wall of cylinder portion 12 a predetermined distance inboard relative to the location of the priming valve structure shown in FIGS. 1 to 3. Thus, axial rib 44 or groove 45 is spaced a greater distance from port 46 compared to that shown in FIGS. 1 to 3.

Therefore, during priming, the deformable seal of secondary piston 41 reaches the priming valve rib or groove before the end of its downstroke, such that during downstroke movements of member 38, its sealing action with the inner surface of cylinder portion 12 is broken before reaching its end-of-stroke position of FIG. 4 to exhaust the entrapped air from the pump chamber into the container through port 46. Continued downstroke movement of member 38 to its lowermost position of FIG. 4 reseals secondary piston 41 to the inner wall of cylinder portion 12 to minimize any drainage of product from a partially primed pump chamber through port 46. Likewise, during the pumping operation, when member 38 has lowered it to its full downward extent during the pumping operation as in FIG. 3, the seal of the secondary piston reseals against the inner surface of cylinder portion 12 when member 38 reaches the end of its downstroke. Any loss of pressurized product from the pump chamber through port 46 during pumping is thereby minimized.

The strokes-to-prime function of the pump according to the invention is improved, and a simple and effective yet highly efficient means is provided for altering the pressure profile of the pump. Moreover, fewer parts and sub-assembly operations are required for the present pump compared to the prior art, thereby improving upon the economy of production and assembly of the pump.

Obviously, many other modifications and variations of the present invention are made possible in the light of the above teachings. It is therefore to be understood that within the scope of the appended claims the invention may be practiced otherwise than as specifically described.

What is claimed is:

1. In a precompression pump sprayer including aligned main and secondary pistons respectively operating in main and secondary portions of a cylinder, the main piston and main cylinder portion defining a pump chamber communicating with a discharge passage located in said main piston and with an inlet passage extending from a container of liquid product to be dispensed, means for reciprocating the pistons substantially in unison against the bias of a return spring, and pump priming means cooperating with said secondary piston during the downstroke movement thereof for expelling entrapped air from said pump chamber, the improvement wherein said inlet passage comprises a conduit extending into said secondary portion to form an annular chamber for housing said return spring, said conduit supporting an inlet check valve, said secondary piston operating in said annular chamber and including a hollow valve member having a discharge valve for controlling the discharge passage, said pump priming means being located in said annular chamber, and said secondary portion having a vent/drain passage establishing communication between said annular chamber and the interior of the container.

2. In the pump sprayer according to claim 1, wherein said valve member is cup-shaped and in sliding sealing engagement with said conduit, said valve member having a flow passage establishing communication between said inlet passage and said pump chamber.

3. In the pump sprayer according to claim 1, wherein said valve member comprises a cup-shaped member telescoped about said conduit in sliding sealing engagement, said valve member having a sidewall containing a flow passage establishing communication between said inlet passage and said pump chamber.

4. In the pump sprayer according to claim 2, wherein said valve member flow passage is sized to prevent hydraulic lock of said valve member during downstroke movement thereof.

5. In the pump sprayer according to claim 3, wherein said flow passage in said sidewall is sized to prevent hydraulic lock of said valve member during downstroke movement thereof.

6. In the pump sprayer according to claim 1, wherein said inlet check valve is supported at an inner end of said conduit adjacent said pump chamber.

7. In the pump sprayer according to claim 1, wherein said priming means is positioned for cooperation with said secondary piston near the end of the downstroke thereof.

8. In the pump sprayer according to claim 1, wherein said priming means is positioned for cooperation with said secondary piston before the end of the downstroke movement thereof.

9. In the pump sprayer according to claim 7, wherein said priming means comprises an axially extending rib on an inner surface of said secondary portion.

10. In the pump sprayer according to claim 7, wherein said priming means comprises an axially extending groove in an inner surface of said secondary piston.

11. In the pump sprayer according to claim 8, wherein said priming means comprises an axially extending rib on an inner surface of said secondary portion.

12. In the pump sprayer according to claim 8, wherein said priming means comprises an axially extending groove in an inner surface of said secondary piston.

13. In a precompression pump sprayer including aligned main and secondary pistons respectively operating in main and secondary portions of a cylinder, the main piston and main cylinder portion defining a pump chamber communicating with a discharge passage located in said main piston and with an inlet passage extending from a container of liquid product to be dispensed, means for reciprocating the pistons substantially in unison against the bias of a return spring, and pump priming means cooperating with said secondary piston during the downstroke movement thereof for expelling entrapped air from said chamber, the improvement wherein said inlet valve controlled passage comprises a conduit extending into said secondary portion to form an annular chamber therewith for housing said return spring, said conduit supporting an inlet check valve, said secondary piston operating in said annular chamber and including a cup-shaped member having a discharge valve for controlling the discharge passage, said member having a flow passage establishing communication between said inlet passage and said pump chamber, said flow passage being sized to control flow of liquid product to said secondary piston during pumping for regulating the rate at which said member controls the discharge passage.

14. In the pump sprayer according to claim 13, wherein said secondary portion has a vent/drain passage establishing communication between said annular chamber and the interior of the container.

15. In the pump sprayer according to claim 13, wherein said priming means is located in said annular chamber and is positioned for cooperation with said secondary piston near the end of the downstroke thereof.

16. In the pump sprayer according to claim 15, wherein said priming means comprises an axially extending rib on an inner surface of said secondary portion.

17. In the pump sprayer according to claim 15, wherein said priming means comprises an axially extending groove in an inner surface of said secondary piston.

18. In the pump sprayer according to claim 13, wherein said priming means is located in said annular chamber and is positioned for cooperation with said secondary piston before the end of the downstroke movement thereof.

19. In the pump sprayer according to claim 18, wherein said priming means comprises an axially extending rib on an inner surface of said secondary portion.

20. In the pump sprayer according to claim 18, wherein said priming means comprises an axially extending groove in an inner surface of said secondary piston.

21. In the pump sprayer according to claim 13, wherein said inlet check valve is supported at an inner end of said conduit adjacent said pump chamber.

* * * * *

UNITED STATES PATENT AND TRADEMARK OFFICE

CERTIFICATE OF CORRECTION

PATENT NO. : 5,560,520

DATED : Oct. 1, 1996

INVENTOR(S) : R. Pat Grogan

It is certified that error appears in the above-indentified patent and that said Letters Patent is hereby corrected as shown below:

In the title page, Items [19] and [75] correct the last name of th to read —Grogan —.

Signed and Sealed this

Tenth Day of December, 1996

*Attest:*

*Attesting Officer*

BRUCE LEHMAN

*Commissioner of Patents and Trademarks*